US009982939B2

(12) United States Patent
Kim

(10) Patent No.: US 9,982,939 B2
(45) Date of Patent: May 29, 2018

(54) DISPENSER STRUCTURE FOR REFRIGERATION EQUIPMENT, APPARATUS AND METHOD FOR CONTROLLING OPERATION OF SAME

(71) Applicant: Dongbu Daewoo Electronics Corporation, Seoul (KR)

(72) Inventor: Dong Sun Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 173 days.

(21) Appl. No.: 14/838,186

(22) Filed: Aug. 27, 2015

(65) Prior Publication Data

US 2016/0370108 A1 Dec. 22, 2016

(30) Foreign Application Priority Data

Jun. 16, 2015 (KR) ..... 10-2015-0084861

(51) Int. Cl.

| | |
|---|---|
| ***F25D 3/00*** | (2006.01) |
| ***F25D 3/12*** | (2006.01) |
| ***F25D 29/00*** | (2006.01) |
| ***F25C 5/00*** | (2018.01) |
| ***F25D 23/12*** | (2006.01) |

(52) U.S. Cl.

CPC ..... *F25D 29/005* (2013.01); *F25C 5/005* (2013.01); *F25D 23/126* (2013.01); *F25C 2600/04* (2013.01); *F25C 2700/02* (2013.01); *F25D 2400/36* (2013.01); *F25D 2700/04* (2013.01)

(58) Field of Classification Search

CPC .. F25D 29/005; F25D 23/126; F25D 2400/36; F25D 2700/04; F25C 5/005; F25C 2700/02

USPC ..... 62/56, 390

See application file for complete search history.

(56) References Cited

U.S. PATENT DOCUMENTS

| | | | | |
|---|---|---|---|---|
| 7,874,460 | B2 | 1/2011 | Jang et al. | |
| 2007/0130965 | A1* | 6/2007 | Boarman | F25D 23/126 62/135 |
| 2008/0173037 | A1* | 7/2008 | Jang | F25C 1/24 62/338 |

(Continued)

FOREIGN PATENT DOCUMENTS

| | | | |
|---|---|---|---|
| KR | 10-0151638 | B1 | 6/1998 |
| KR | 1020090009328 | A | 1/2009 |

(Continued)

*Primary Examiner* — Frantz Jules
*Assistant Examiner* — Steven Tanenbaum

(57) ABSTRACT

A dispenser on refrigerator including a touch pad-type of lever for dispensing water supplied from a water purifier. The dispenser includes a main body, an ice discharge port, an ice guide, an ice discharge lever and a water discharge port. A PCB substrate is mounted on the front side of the ice guide. The touch pad-type lever is mounted on the PCB substrate and configured to receive a user request for discharging water and accordingly control a state of the water discharge port. The refrigerator also ice maker coupled to the dispenser, and detectors for detecting the amount of ice and water contained in the ice maker and the water purifier respectively. The touch pad on the touch pad-type of lever can display the amount of ice and water contained in the ice maker and the water purifier respectively.

7 Claims, 5 Drawing Sheets

(56) References Cited

U.S. PATENT DOCUMENTS

| | | | | |
|---|---|---|---|---|
| 2009/0013708 | A1* | 1/2009 | Truitt | F25D 23/126 62/264 |
| 2010/0319388 | A1 | 12/2010 | Yang et al. | |
| 2011/0083457 | A1 | 4/2011 | Jang et al. | |
| 2013/0207530 | A1* | 8/2013 | Yeo | F25D 23/028 312/405 |
| 2014/0305927 | A1* | 10/2014 | Alexander | A47G 19/027 219/387 |

FOREIGN PATENT DOCUMENTS

| | | | |
|---|---|---|---|
| KR | 1020100137378 | A | 12/2010 |
| KR | 1020120084214 | A | 7/2012 |
| KR | 1020130092278 | A | 8/2013 |
| KR | 10-2014-0022932 | | 2/2014 |

* cited by examiner

DISPENSER STRUCTURE FOR REFRIGERATION EQUIPMENT, APPARATUS AND METHOD FOR CONTROLLING OPERATION OF SAME

This application claim priority to and benefit of Korean Patent Application No. 10-2015-0084861, filed on Jun. 16, 2015, the entire content of which is incorporated herein by reference for all purposes.

TECHNICAL FIELD

Embodiments of the present invention relate to refrigerators, and more particularly, to water/ice dispensing mechanisms on refrigerators.

BACKGROUND

Refrigerators are electrical appliances capable of maintaining a storage chamber below the room temperature. Food can be stored in a refrigerator in a cold or frozen state. A refrigerator may include a refrigerating compartment maintained at a temperature above zero degree celsius and a freezing compartment (or a freezer) maintained below zero degrees.

Recently, with the increasing demand for purified water and ice at home, the demand for refrigerators integrating a water purifier and an ice maker has increased. An ice maker may be installed in the freezer, in the refrigerating compartment, or on the door of the refrigerator. A dispenser is installed on the exterior of a front door of the refrigerator for dispensing water or ice responsive to user requests. FIG. 1 shows a conventional dispenser configuration in a refrigerator.

Referring to FIG. 1, a main body 102 (or housing) of a dispenser is disposed on the exterior of the refrigerator front door and includes a cavity directing to the inside of the door. In this cavity, an ice discharge port 104, an ice guide 106, a water discharge port 108, a water discharge lever 110, and an ice discharge lever 112 may be installed.

More specifically, the ice discharge port 104 may be disposed on one side (i.e., inside the cavity) of the main body 102 of the dispenser. The ice guide 106 may be coupled to the tip (the protruding end) of the ice discharge port 104 and may be used as a channel to guide ice from the ice discharging port to the outside of the refrigerator. The water discharge port 108 may be coupled to the other side (i.e., outside the cavity) of the main body 102.

On one side (e.g., outward side) of the ice guide 106, there is a water discharge lever 110 with a switch (not shown) on the back. By pressing the water discharge lever 110, a user can have water discharged through the water discharge port 108.

Similarly, on one side of the inner wall surface of the cavity, there is an ice discharge lever 112 with a switch (not shown) on the back. By pressing the ice discharge lever 112, a user can have ice discharged to the outside of the refrigerator through the ice guide 106.

In such a conventional refrigerator, the water/ice discharge levers for selectively discharging water and ice typically use mechanical switches.

SUMMARY

There is a need for users to determine the amount of water and ice left in the water purifier and the ice maker without opening or otherwise operating the refrigerator.

Embodiments of the present invention provide a water/ice dispenser structure for refrigerators that can enhance user experience with the dispenser in which a touch pad lever is employed as a switch for discharging water.

Exemplary embodiments of the present disclosure provide a dispenser structure for a refrigerator, including: a main body of the dispenser; an ice discharge port disposed at one side of the main body of the dispenser and configured to open or close for discharging or stopping discharging ice; an ice guide coupled to the tip of the ice discharge port; an ice discharge lever configured to operate the on/off of the ice discharge at the ice discharge port; a water discharge port disposed at the other side of the main body of the dispenser and configured to open or close for discharging or stopping discharging water; a PCB substrate mounted on the front side of the ice guide; and a touch pad-type lever mounted on the PCB substrate and configured to receive user input and accordingly switch on or off the water discharge from the water discharge port.

The touch pad-type lever may be any one of a LCD touch pad, a LED touch pad, and an OLED touch pad.

Exemplary embodiments of the present disclosure also provide an apparatus for controlling the operation of a dispenser on a refrigerator. The refrigerator includes: a main body of the dispenser; an ice discharge port disposed at one side of the main body of the dispenser and configured to open or close for discharging or stopping discharging ice; an ice guide coupled to the end of the ice discharge port; an ice discharge lever configured to operate the on/off of the ice discharge at the ice discharge port; a water discharge port disposed at the other side of the main body of the dispenser and configured to open or close for discharging or stopping discharging water; a PCB substrate mounted on the front side of the ice guide; a touch pad-type lever mounted on the PCB substrate and configured to generate a touching signal for the water discharge; when a press on the ice discharge lever is sensed, a sensing element configured to generate a corresponding sensing signal of ice discharge; and a control unit configured to control the "open" or "close" state of the ice discharge port according to the sensing signal, and the water discharge port according to the touching signal, respectively.

The apparatus for controlling the operation of a dispenser for refrigerator may further include a user presence detecting sensor configured to detect a user approaching to the touch pad-type lever. When a touch on the touch pad lever and a user presence are both detected, the control unit causes the water discharge port to open.

The touch pad-type lever may be configured to display information regarding the amount of water contained in the refrigerator on a predetermined area of the touch pad.

The apparatus may further include a water quantity detector for detecting a residual quantity of water contained in the refrigerator.

The touch pad-type lever may be configured to display information on a residual quantity of ice contained in the refrigerator on a predetermined area of the touch pad.

The apparatus for controlling the operation of a dispenser for refrigerator may further include an ice quantity detector for detecting a residual quantity of ice contained in the refrigerator.

When a press on the ice discharge lever is sensed, a switch in the lever is configured to generate the sensing signal indicative of a user request for ice discharge. When the press on the ice discharge lever is released, a restoring member restores automatically the position of the ice discharge lever to a neutral position.

The restoring member may be a spring structure installed at the back side of the ice discharge lever.

Further exemplary embodiments of the present disclosure provide a method for controlling the operation of a dispenser for a refrigerator. The method includes detecting a press by a user on an ice discharge lever for discharging ice through an ice discharge port of the dispenser, and detecting a touch by a user on a touch pad-type lever mounted on a PCB substrate for discharging water through a water discharge port.

When a press is sensed, the ice discharge port is opened and ice is discharged therefrom. When a touch is sensed, the water discharge port is opened to discharge water. When the press is released, the ice discharge port is closed to stop ice discharge. When the touch is released, the position of the ice discharge lever is restored automatically to neutral; the water discharge port is closed to stop water discharge.

Therefore, by employing a touch pad-type lever as a user interface for receiving user requests for dispensing water, user experience of the dispenser-type refrigerator can be advantageously improved. The touch pad can conveniently display information regarding the water purifier and the ice maker to a user without the user needing to interact with the refrigerator.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION

Figure 1:
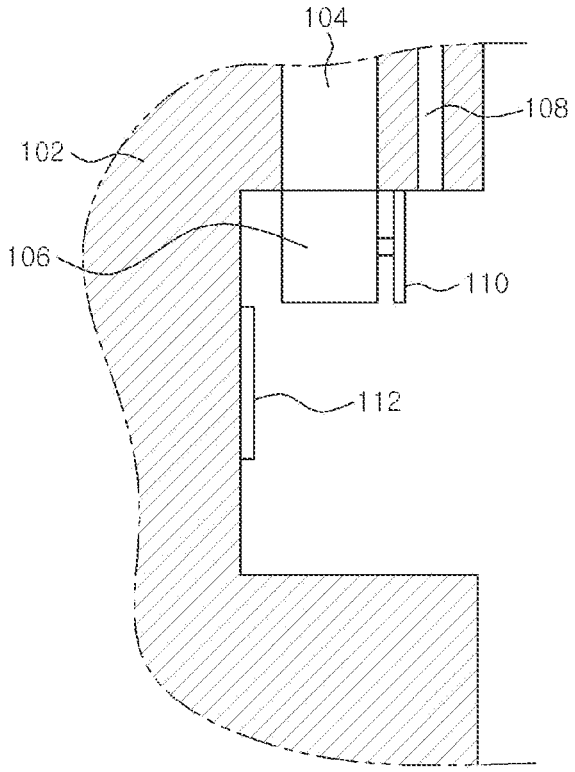
FIG. 1 (PRIOR ART)
FIG. 1 is a side cross-sectional view of a typical dispenser provided in a conventional refrigerator.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

NOTATION AND NOMENCLATURE

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or display devices. When a component appears in several embodiments, the use of the same reference numeral signifies that the component is the same component as illustrated in the original embodiment.

Figure 2:
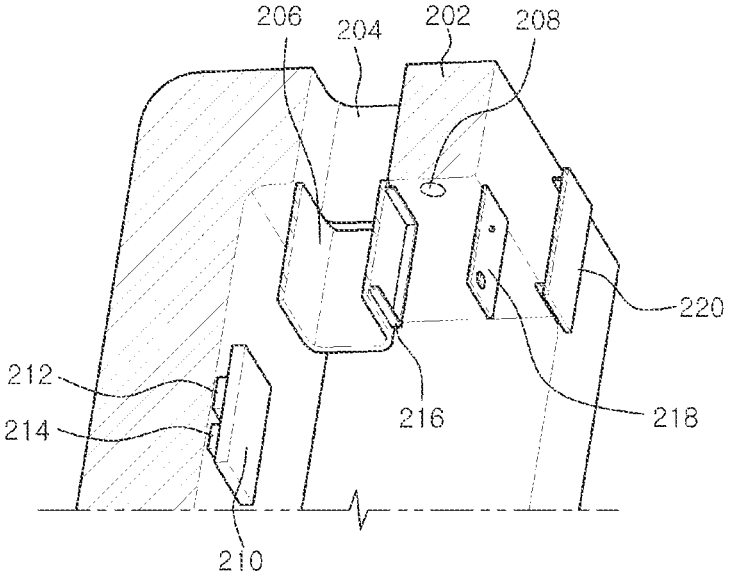
FIG. 2 is a side cross-sectional view of an exemplary dispenser configuration of a refrigerator in accordance with an embodiment of the present invention.
Figure 3:
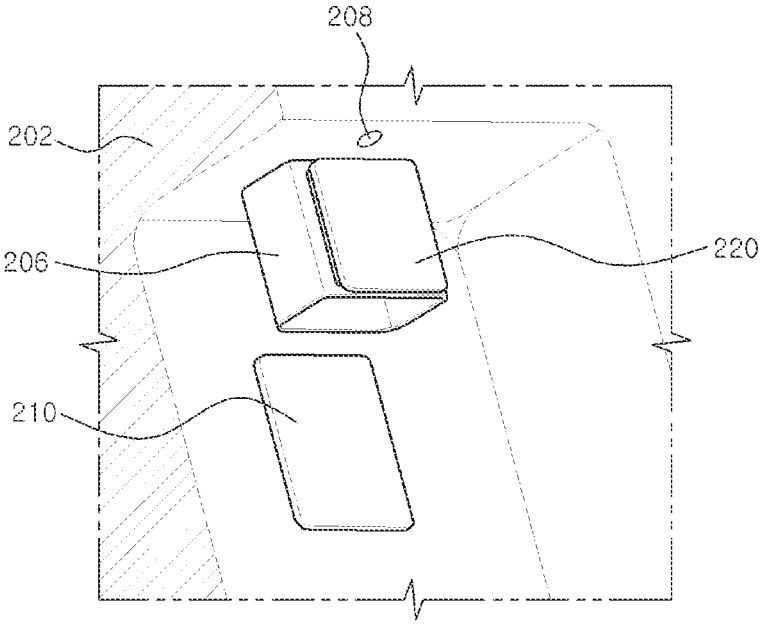
FIG. 3 is a configuration of an exemplary dispenser of a refrigerator in which a touch pad-type lever mounted on a PCB substrate is assembled on one side of an ice guide in accordance with an embodiment of the present invention.

FIG. 2 illustrates a side cross-sectional view of an exemplary dispenser of a refrigerator in accordance with an embodiment of the present invention. FIG. 3 is a structural view of a dispenser structure on a refrigerator in which a touch pad-type lever mounted on the PCB substrate is assembled on the ice guide in accordance with an exemplary embodiment of the present invention.

Referring FIG. 2, a dispenser is installed on the exterior of the front door of the refrigerator (not shown). A water purifier and an ice maker are installed in the refrigerator. The dispenser is configured to dispense water from a water purifier and ice from an ice maker, e.g., when the door is closed. In the dispenser, a cavity space is defined by a main body 202 (or housing) and directs to the inner side of the door. Inside the cavity, an ice discharge port 204, an ice guide 206, a water discharge port 208, an ice discharge lever 210, a switch 212, a restoring member 214, a fixing member 216, a PCB substrate 218, and a touch pad-type lever 220 may be installed. In this configuration, the ice maker may, for example, be disposed inside the front door of the refrigerator.

The ice discharge port 204 is installed on one side (e.g., inside the cavity) of the main body 202 of the dispenser. The ice discharge port is capable of discharging ice to the outside, responsive to a user request. The ice discharge port 204 may include the ice guide 206 installed at the end of the port 204. For instance, the end of the port 204 has a protruding tip. When the ice discharge port 204 is open, the ice guide 206 guides ice discharged from the port 204 in a deterministic path.

On the other side (e.g., outside the cavity) of the main body 202 of the dispenser, the water discharge port 208 can discharge water to the outside of the refrigerator. For example, the water is supplied from a water purifier disposed inside the refrigerator.

The ice discharge lever 210 is disposed on the same side of the inner wall of the dispenser as the cavity. The lever 210 functions as a press switch for ice discharge. A switch 212 is disposed on the back side of the ice discharge lever 210 and used to generate a sensing signal upon detecting a request for opening the ice discharge port 204. For example, the request is generated when the ice discharge lever 210 is pressed, e.g., by a user. A restoring member 214 is also disposed on the back side of the ice discharge lever 210. When the press on the ice discharge lever 210 is released, the restoring member can restore automatically the position of the ice discharge lever 210 to the original position prior to being pressed, e.g., a neutral position. In this configuration, the restoring member 214 may be, for example, a spring structure.

Herein, the switch 212 and the restoring member 214 may be collectively referred to as a sensing element for ice discharge. As described above, when a press on the ice discharge lever 210 is sensed, the switch 212 generates a corresponding sensing signal indicative of a user request for discharging ice and transmits the sensing signal to a control unit 406, as to be described in greater detail with reference to FIG. 4. When the press on the ice discharge lever 210 is released, the restoring member 214 automatically restores the position of the ice discharge lever 210 to neutral.

On the other hand, a fixing member 216 is disposed on the front side of the ice guide 206 and coupled to the PCB substrate 218 mechanically and electrically. A touch pad-type lever 220 is mounted on the PCB substrate 218, as shown in FIG. 3 as an example, can control water discharge. The touch pad-type lever 220 may be, for example, a flat panel display, such as a liquid crystal display (LCD) touch pad, a light-emitting diode (LED) touch panel, an organic light-emitting diode (OLED) touch panel, etc. An electrostatic touch sensor or the like may be installed inside the touch pad-type lever 220.

In another embodiment, a user presence detector (e.g., an infrared sensor) for detecting a user (e.g., a hand holding a cup) approaching to the touch pad-type lever 220 may also be installed in the vicinity of the water discharge port 208. The user presence detector is used to determine whether the object touching the touch pad-type lever 220 for discharging water is a user's body part or a conductive material (e.g., metal material), which will be described in greater detail with reference to FIG. 4.

In addition, the touch pad-type lever 220 mounted on the PCB substrate 218 may enable display of the residual quantity of water contained in the water purifier on the touch pad. To this end, a water quantity detector for detecting the amount of water currently contained in the water purifier may be installed.

Similarly, the touch pad-type lever 220 mounted on the PCB substrate 218 may display a representation of the amount of ice currently contained in the ice maker provided in the refrigerator on a predetermined area of the touch pad. To this end, an ice quantity detector for detecting a residual quantity of ice contained in the ice maker (e.g., disposed inside the door of the refrigerator) may be installed.

During manufacturing or maintenance, the touch pad-type lever 220 may be assembled to the main body 202 of the dispenser according to the following process:

(1) preparing the main body 202 of the dispenser having the ice discharge port 204 and the water discharge port 208 formed therein;

(2) assembling the ice guide 206 at the end (or tip) of the ice discharge port 204;

(3) assembling the PCB substrate 218 on the front side of the ice guide 206 where the fixing member 216 is installed; and (4) assembling the touch pad-type lever 220 on the PCB substrate 218 mechanically and electrically.

When a user presses the ice discharge lever 210 that interlocks with the switch 212 installed on its back side, ice can be dispensed from the ice discharge port 204 through the ice guide 206. When the user releases the ice discharge lever 210, the position of the ice discharge lever 210 may be restored automatically by the restoring member 214, and at the same time, ice discharged is stopped.

Similarly, when a user touches the touch pad-type lever 220 mounted on the PCB substrate 218 with a body part such as a finger, water is dispensed to the outside of the refrigerator from the water discharge port 208. When the user releases the touch on the touch pad-type lever 220, water discharge is stopped.

Figure 4:
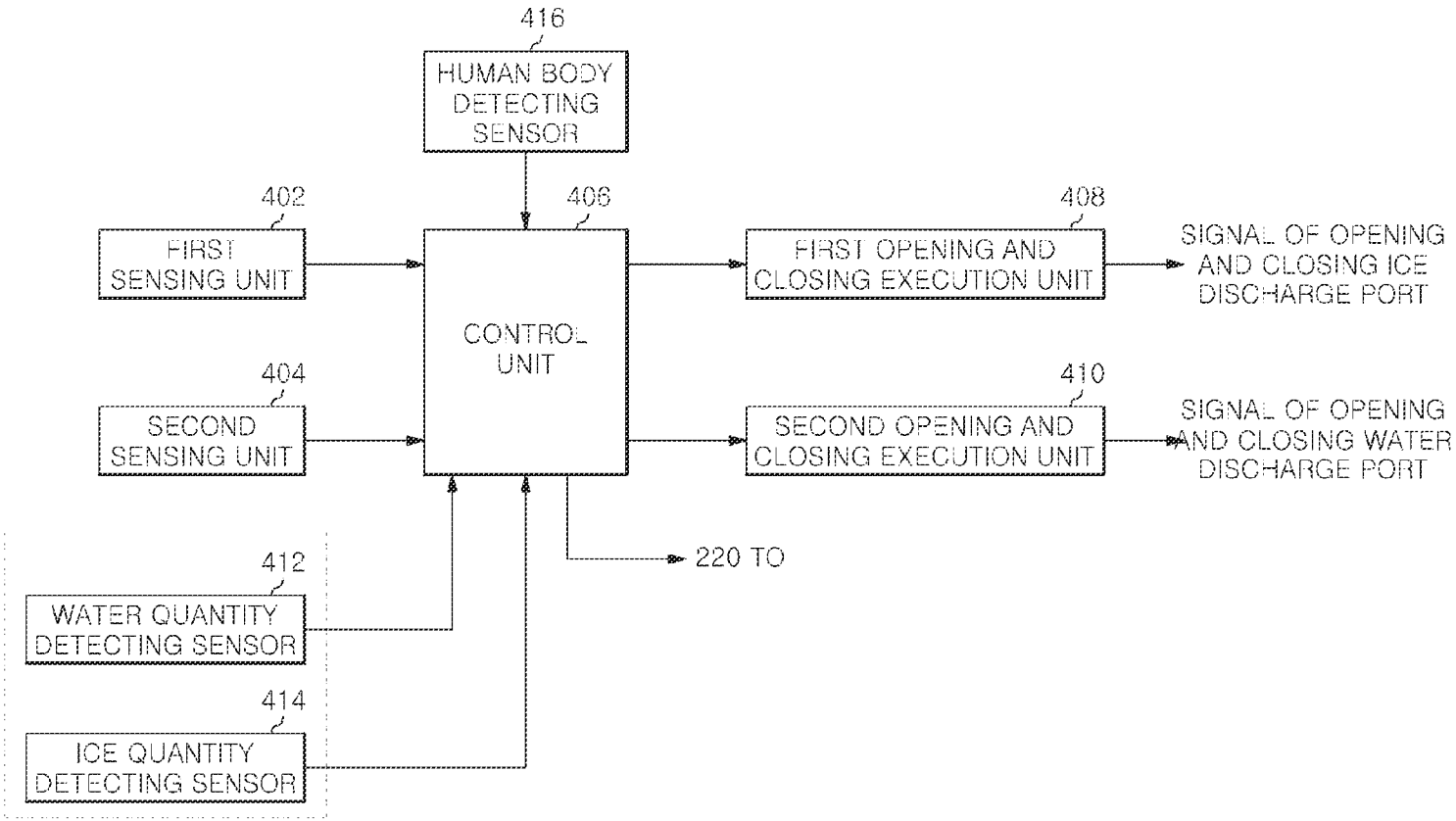
FIG. 4 is a functional block diagram of a circuit device for operating an exemplary dispenser of a refrigerator in accordance with an embodiment of the present invention.

FIG. 4 is a function block diagram of a circuit device for controlling a dispenser structure in accordance with the present invention. The circuit device may include a first sensing unit 402, a second sensing unit 404, a control unit 406, a first opening and closing execution unit 408, and a second opening and closing execution unit 410.

Referring to FIG. 4, the first sensing unit 402 may correspond to, for example, the switch 212 shown in FIG. 2. The sensing unit 402 can detect a press on the ice discharge lever 210, generate the sensing signal and transmit it to the control unit 406. In response to the signal, the ice discharge port 204 is opened to allow ice to be discharged. The sensing unit 402 can also detect a release of the press on the ice discharge lever 210, generate a corresponding sensing signal of releasing and transmit the sensing signal to the control unit 406.

The second sensing unit 404 may correspond to, for example, a touch sensor built in the touch pad-type lever 220 shown in FIG. 2. When a press on the touch pad-type lever 220 is sensed, the second sensing unit 404 generates a sensing signal indicative of the user pressing to open the water discharge port 208 and transmits the sensing signal to the control unit 406. When the touch on the touch pad-type lever 220 is released, the second sensing unit 404 generates a corresponding sensing signal of releasing and transmits the sensing signal to the control unit 406.

The control unit 406 may correspond to, for example, a microprocessor executing the control operations for the refrigerator. When a sensing signal of pressing is input from the first sensing unit 402, the control unit 406 generates an opening command to open the ice discharge port 204, and the opening command is transmitted to the first opening and closing execution unit 408 for execution. When a sensing signal of releasing is input from the first sensing unit 402, the control unit 406 generates a closing command for execution by the first opening and closing execution unit 408.

Similarly, when a sensing signal of touching is input from the second sensing unit 404, the control unit 406 generates an opening command to open the water discharge port 208. The opening command is transmitted to the second opening and closing execution unit 410 for execution. When a sensing signal of releasing is input from the second sensing unit 404, the control unit 406 generates a closing command and transmits it to the second opening and closing execution unit 410 for execution.

The first opening and closing execution unit 408 may include a solenoid valve and a driving circuit, or the like. When an opening command is transmitted from the control unit 406, the first opening and closing execution unit 408 opens the ice discharge port 204. When a closing command is transmitted from the control unit 406, the first opening and closing execution unit 408 closes the ice discharge port 204.

Similarly, the second opening and closing execution unit 410 may include a solenoid valve and a driving circuit, or the like. When an opening command is transmitted from the control unit 406, the second opening and closing execution unit 410 opens the water discharge port 208. When a closing command is transmitted from the control unit 406, the second opening and closing execution unit 410 closes the water discharge port 208.

According to another embodiment of the present invention, the apparatus for controlling operation of the dispenser may further include a water quantity detector 412 and an ice quantity detector 414, as shown by the dotted box in FIG. 4.

More specifically, the water quantity detector 412 may detect a residual quantity of water contained in the water purifier of the refrigerator and transmit the detected value to the control unit 406, e.g., periodically. The ice quantity detector 414 may detect a residual quantity of ice contained in the ice maker of the refrigerator and transmit the detected value to the control unit 406, e.g., periodically.

In response to the signals transmitted from the detectors 412 and 414, the control unit 406 converts the residual quantity of water and the residual quantity of ice into percentage numbers remaining and transmits the numbers to the touch pad-type lever 220. As a result, the residual quantity of water and the residual quantity of ice may be displayed on the touch pad of the touch pad-type lever 220.

In addition, the apparatus for controlling operation of the dispenser of the present invention may further include a user presence detector 416 for detecting a user proximate to the touch pad-type lever 220. In this embodiment, when a touch signal is input from the second sensing unit 404 and at the same time a user presence signal is input from the user presence detector 416, the water discharge port 208 is opened. An infrared sensor or the like may be used as the user presence detector 416. Using a user presence detector 416 can advantageously prevent water from being discharged absent a user's intentional act. For example, if an object (e.g., a conductive metal material) other than a body part (e.g., a finger) touches the touch pad-type lever 220, the water discharge port will not be opened due to the lack of a sensing signal from the user presence detector 416, thereby safety and reliability of using the dispenser can be achieved.

Figure 5:
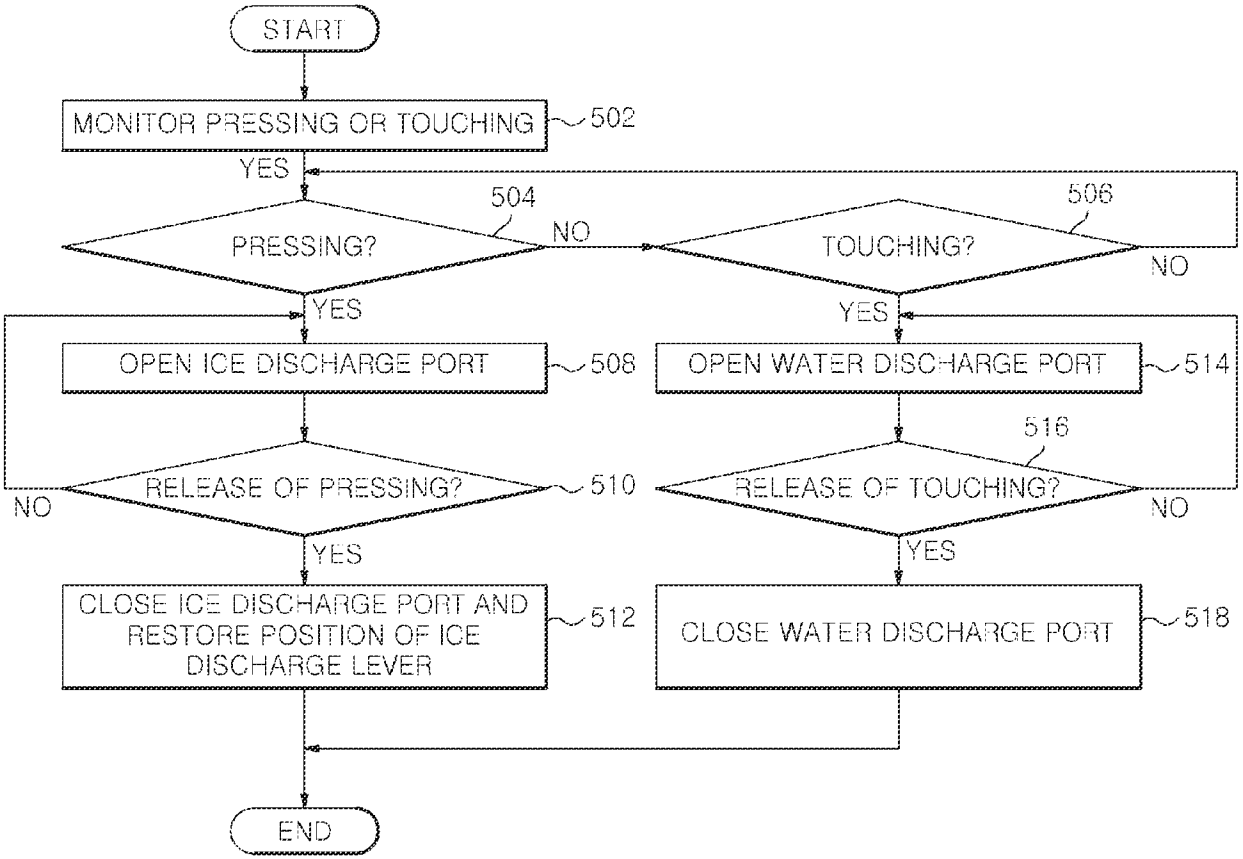
FIG. 5 is a flow diagram showing an exemplary process of controlling the operation of a dispenser in accordance with an embodiment of the present invention.

FIG. 5 is a flow diagram showing an exemplary process of controlling the operation of a dispenser on a refrigerator in accordance with an embodiment of the invention.

Referring to FIG. 5, at 502, the control unit 406 monitors whether a press on the ice discharge lever 210 is detected and whether a touch on the touch pad-type lever 220 is detected.

More specifically, when a press on the ice discharge lever 210 is sensed, the switch 212 generates a sensing signal indicative of a request for opening the ice discharge port 204 and transmits the sensing signal to the control unit 406. When a touch (e.g., by a user's finger) on the touch pad-type lever 220 is sensed, the touch sensor built in the touch pad-type lever 220 generates a touching signal indicative of a request for opening the water discharge port 208 and transmits the touching signal to the control unit 406.

First, at 504, if it is determined that a press on the ice discharge lever 210 (e.g., by a user) is sensed, the control unit 406 generates an open command and transmits the open command to the first opening and closing execution unit 408 to enable ice discharge. Consequently, the ice discharge port 204 is opened responsive to the opening execution by the first opening and closing execution unit 408. Accordingly ice is discharged to the outside, at 508.

At this time, at 510, the control unit 406 determines whether a sensing signal of releasing of the ice discharge lever 210 is input from the switch 212. When it is confirmed that the sensing signal of releasing is input, the control unit 406 generates a closing command and transmits the closing command to the first opening and closing execution unit 408 to stop ice discharge. Consequently, the ice discharge port 204 is closed responsive to the closing execution at the first opening and closing execution unit 408. At the same time, the position of the ice discharge lever 210 is restored automatically to the original position by the restoring member 214, at 614. In other words, the ice discharge port 204 is opened for ice discharging only when the ice discharge lever 210 is pressed.

On the other hand, if, at 506, it is determined that a touch on the touch pad-type lever 220 is sensed, the control unit 406 generates an opening command and transmits the opening command to the second opening and closing execution unit 410. Consequently, at 514, the water discharge port 208 is opened according to the opening execution at the second opening and closing execution unit 410. Accordingly, water is discharged to the outside.

At 516, the control unit 406 determines whether the touch on the touch pad-type lever 220 is released as sensed by the touch sensor. If yes, the control unit 406 generates a closing command and transmits the closing command to the second opening and closing execution unit 410. Consequently, the water discharge port 208 is closed according to the closing execution at the second opening and closing execution unit 410. Accordingly, water discharge is stopped at 518. In other words, the water discharge port 208 is opened to allow water to be discharged to the outside only when the touch pad-type lever 220 is touched.

In the embodiment with reference to FIG. 5, it has been described that when a touch on the touch pad-type lever 220 is sensed, the water discharge port is opened to discharge water to the outside. However, the present invention is not limited thereto. In some other embodiments, only when both a touch on the touch pad lever and a user presence are simultaneously detected is the water discharge port opened to discharge water to the outside.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. An apparatus for controlling the operation of a dispenser for a refrigerator, the apparatus comprising:

a housing of the dispenser;

an ice discharge port configured to open or close for selective discharging of ice;

an ice guide coupled to a lower portion of the ice discharge port and configured to convey ice discharged from the ice discharge port to an outside of the refrigerator;

an ice discharge lever coupled to the ice discharge port and configured to control a state of the ice discharge port;

a water discharge port configured to open or close for selective discharging of water; a circuit board coupled to the ice guide;

a touch pad lever mounted on the circuit board, wherein the touch pad lever is configured to generate a touching signal upon receiving a user input for water dispensing;

responsive to detection of a user interaction on the ice discharge lever, a sensing element configured to generate a sensing signal of ice discharge; and a control unit configured to control an opening of the ice discharge port according to the sensing signal of ice discharge and to control an opening of the water discharge port according to the touching signal, wherein the touch pad lever is installed on a front surface of the ice guide and disposed between the water discharge port and the ice discharge lever, and wherein the touch pad lever is configured to display a residual quantity of at least one of water and ice contained in the refrigerator, and wherein the residual quantity is displayed between the water discharge port and the ice discharge lever.

2. The apparatus of claim 1, wherein the ice discharge port and the water discharge port are disposed on different sides of the housing.

3. The apparatus of claim 1 further comprising: a user presence detector configured to detect a user presence proximate to the touch pad lever, wherein, when a touch on the touch pad lever and a user presence are simultaneously detected, the control unit causes the water discharge port to open.

4. The apparatus of claim 1, further comprising a water quantity detector for detecting a residual quantity of water contained in the refrigerator.

5. The apparatus of claim 1, further comprising an ice quantity detector for detecting a residual quantity of ice contained in the refrigerator.

6. The apparatus of claim 1, wherein the sensing element comprises:

a switch configured to generate the sensing signal of ice discharge responsive to sensing a press on the ice discharge lever; and a restoring member configured to restore the position of the ice discharge lever to an original position upon the press being released.

7. The apparatus of claim 6, wherein the restoring member is a spring structure installed at a back side of the ice discharge lever.

* * * * *